US006068556A

United States Patent [19]

Bernstein

[11] Patent Number: 6,068,556

[45] **Date of Patent: *May 30, 2000**

[54] MOBILE SCENERY ARRANGEMENT

[76] Inventor: Patrik L. T. Bernstein, Wulffs gata 11, 260 93 Torekov, Sweden

[ * ] Notice: This patent is subject to a terminal disclaimer.

[21] Appl. No.: 09/288,766

[22] Filed: Apr. 8, 1999

Related U.S. Application Data

[63] Continuation of application No. 08/845,324, Apr. 25, 1997, Pat. No. 6,004,216.

[51] Int. Cl.[7] ..... A63J 1/02

[52] U.S. Cl. ..... 472/77; 472/79

[58] Field of Search ..... 472/77, 79, 75, 472/76, 78; 135/100, 122, 123, 143

[56] References Cited

U.S. PATENT DOCUMENTS

| | | | |
|---|---|---|---|
| 1,533,337 | 4/1925 | Purdy et al. | 472/75 |
| 1,828,535 | 10/1931 | Kass . | |
| 2,511,452 | 6/1950 | Anderson et al. . | |
| 2,828,757 | 4/1958 | Thaxton, Jr. . | |
| 2,846,221 | 8/1958 | Skinner . | |
| 3,596,701 | 8/1971 | Cowan . | |
| 4,077,418 | 3/1978 | Cohen . | |
| 4,764,142 | 8/1988 | Griffith et al. | 472/77 X |
| 5,096,214 | 3/1992 | Walker et al. . | |
| 5,117,853 | 6/1992 | Pruesner . | |
| 5,194,047 | 3/1993 | Cabell . | |
| 5,352,149 | 10/1994 | Melashenko et al. . | |
| 5,414,950 | 5/1995 | Johnson, Sr. . | |
| 5,524,691 | 6/1996 | Jines . | |

FOREIGN PATENT DOCUMENTS 2240047A 7/1991 United Kingdom .

OTHER PUBLICATIONS

Patent Cooperation Treaty PCT International Search Report regarding International Application No. PCT/SE97/00603; International Filing Date: Apr. 10, 1997; Applicant: Global Act AB.

*Primary Examiner*—Kien T. Nguyen
*Attorney, Agent, or Firm*—Kelly Bauersfeld Lowry & Kelley, LLP

[57] ABSTRACT

A mobile scenery arrangement is provided which is easy to assemble and dismantle, and which can easily be transported, stored and used with uniform curtains and a uniform set of back-drops for the same performance. The mobile scenery arrangement includes a tubular construction forming a substantially vertical left side and a substantially vertical right side, the left and right sides being joined to at least one upper front curtain rod and at least one upper rear back-drop rod via corner members. At least one of the ends of the front curtain rod and the rear back-drop rod is provided with a cord-tensioning device arranged to steplessly stretch a cord between the two ends of the rod. The cord is arranged to displaceably carry curtains or a back-drop.

20 Claims, 1 Drawing Sheet

MOBILE SCENERY ARRANGEMENT

RELATED APPLICATION

This is a continuation of U.S. patent application Ser. No. 08/845,324, filed Apr. 25, 1997 now U.S. Pat. No. 6,004, 216.

BACKGROUND OF THE INVENTION

1. Technical Field

The present invention relates to stages, scenery, curtains, back-drops and decor for theatre productions, particularly for children's theatre productions of fairy-tales and the like, but also for teaching and educational purposes.

2. Background Art

Previously plays and fairy-tales were performed for children, the scenery, with curtains and back-drops, being made by hand for each occasion and each production. No ready-made stands were normally available for the scenery at nursery or comprehensive schools, etc. and it is difficult to dismantle the scenery and move it to another place.

Simple theatre productions of children's plays should allow for three changes of back-drop, preferably taking place behind closed curtains. There should also be spaces hidden from the public, for assistants, actors with costume changes, prompters, etc.

Such relatively simple scenery is time-consuming and resource-demanding to produce with conventional props and normal work methods.

OBJECT OF THE INVENTION

The object of the invention is to provide a scenery arrangement that is easy to assemble and dismantle and can easily be transported and stored and used with uniform curtains and a uniform set of back-drops for the same performance.

The object is also to facilitate theatre productions and plays for children by means of the mobile scenery arrangement according to the present invention as defined in the appended claims.

SUMMARY OF THE INVENTION

The present invention relates to a mobile scenery arrangement for theatrical use, which is assembled from connectable rod sections preferably having a length of 1 m. This basic concept allows scenery arrangements of varying sizes to be built in intervals of 1 m. The height is usually 2 m, the width 5 m and the depth 2 m.

The rod sections are also secured in corner members in order to construct a box-like tubular construction forming a substantially vertical left side and a substantially vertical right side, the left and right sides being joined to at least one upper front curtain rod and at least one upper rear back-drop rod, at least one of the ends of said rods being provided with a cord-tensioning device arranged to stretch a cord between the two ends of the rod, said cord being arranged to displaceably carry curtains or back-drop.

A stable tubular construction is thus obtained for curtains and back-drops to be attached on its curtain and back-drop rods. The taut cord at the upper front curtain rod is used to displaceably carry the curtain, while the taut cord of the upper rear back-drop rod is used to displaceably carry scenery back-drops.

A scenery arrangement according to the present invention is also suitable for packing into a suitable case in which each component has its place, for transport and storage.

BRIEF DESCRIPTION OF THE DRAWINGS

The invention will now be described in more detail with reference to the accompanying drawings.

DETAILED DESCRIPTION OF THE PREFERRED EMBODIMENT

Figure 1:
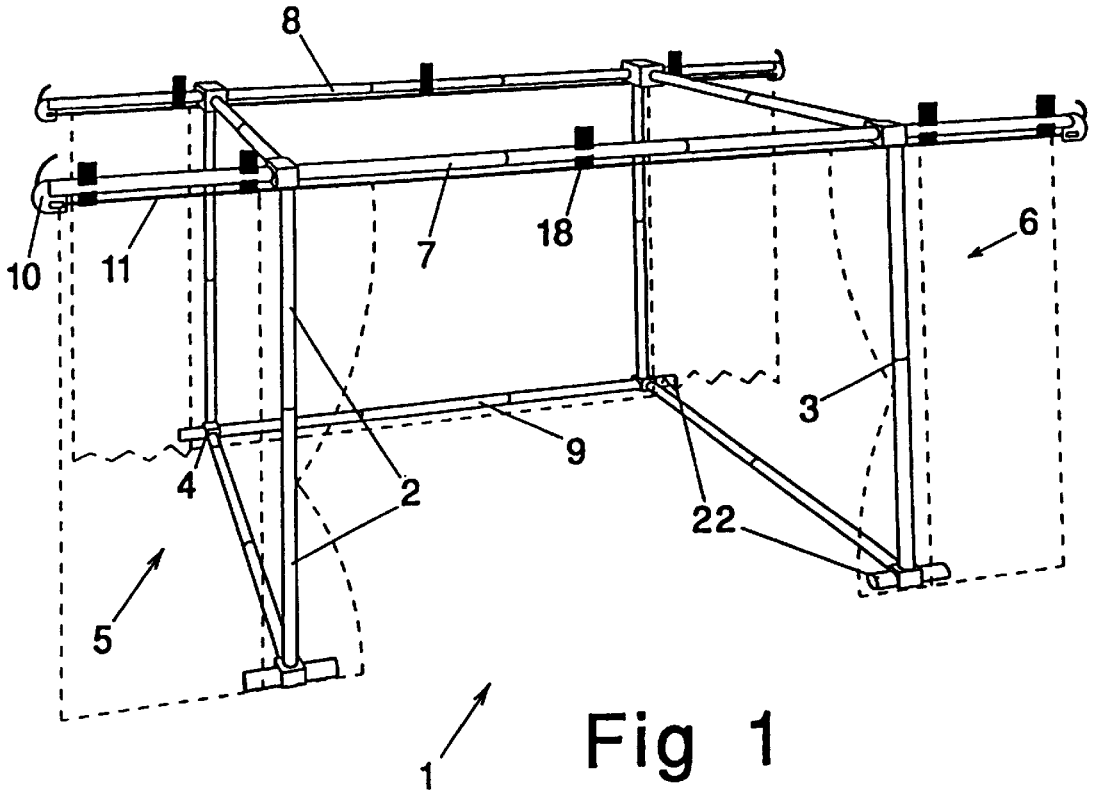
FIG. 1 shows schematically in perspective, a view of a scenery arrangement according to the present invention.

A mobile scenery arrangement according to the present invention is based on a tubular construction 1 comprising first rod sections 2, preferably aluminum rods with circular cross-section, joined by means of connectors 3 to desired lengths, which, with the aid of corner members 4, are fitted together to form a substantially vertical left side 5 and a substantially vertical right side 6, the left and right sides being joined at least one upper front curtain rod 7 and at least one upper rear back-drop 8 so that the tubular construction forms a box-like space. Both sides are also connected with a rear lower spacer 9.

Each corner member 4 is shaped to enable rod sections to be joined together to form a box-like construction. The corner members 4 are preferably identically shaped, each having four rod connections.

A cord-tensioning device 10 is also arranged to stretch a cord 11 between the two ends of the curtain rod 7 and/or back-drop rod 8. The cord 11 thus presses together the curtain or back-drop rod axially at the same time as providing a suspension arrangement suitable for displacement of curtains or back-drops. As can be seen in FIG. 1, both ends of the curtain and back-drop rods may be provided with cord-tensioning devices.

Figure 2:
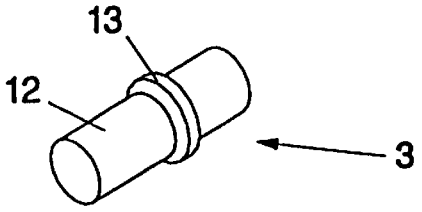
FIG. 2 shows a connector for rods according to the present invention.

The connector 3, see FIG. 2, consists of a relatively long connecting piece 12 which can be inserted with relatively tight fit into the ends of the rod sections in order to establish steadiness in the finished construction. The connecting piece 12 is provided centrally with a support flange 13 of the same exterior shape as that of the rod sections. The invention is not limited to the use of only rod sections of circular cross sections and these sections may also have rectangular, square or elliptical cross-section, for instance, in which case the other components in the construction shall be modified to suit the cross section of the rod.

As can be seen in FIG. 1, the curtain rod 7 extends outside the left side 5 and also outside the right side 6 so that, when the curtain is closed it also hides props, actors and assistants outside the actual stage area. When the curtain is fully open a certain amount of space on each side of the actual stage is still hidden.

The back-drop rod 8 also extends past both the left and the right sides so that a back-drop which, similar to a curtain, is suspended on a corresponding cord, can be displaced from the left side across the stage and out to the right. If three back-drops are used, maximally two back-drops are suspended on the cord at the rod section extending outside the left or right side. The cord at the back-drop rod and the extension of the back-drop rod outside the left and right sides thus contribute to facilitating change of back-drop.

Figure 3:
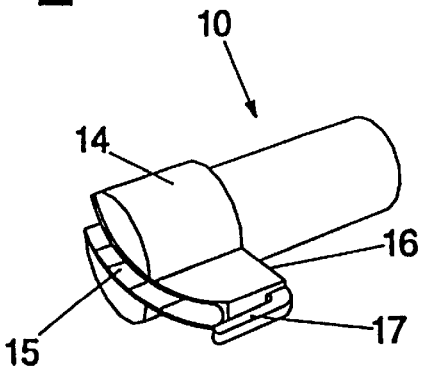
FIG. 3 shows a cord-tensioning device according to the present invention.

The cord-tensioning device 10, in the form of a plug insertable into the end of the rod, see FIG. 3, is provide with an attachment part 14 provided with a retaining slit 15 in conjunction with a cord guide 16 in the form of an aperture through the attachment part, parallel with the curtain/back-drop rod 7, 8. The cord 11 is thus guided through the cord guide 16 so that a suitable distance is obtained between cord and curtain/back-drop. The retaining slit 15 is designed to perform its function like a simple sheet clamp on a sailing boat so that the cord can be steplessly secured in the slit which has no movable parts. The attachment part 14 is provided with at least one curtain hook 17 on which the end of the curtain is secured to prevent it from being displaced during manipulation.

Figure 4:
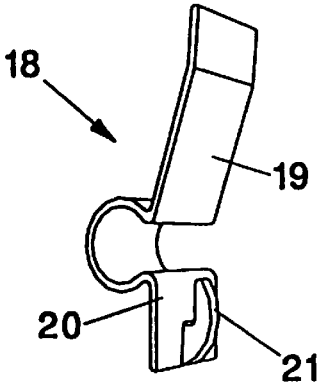
FIG. 4 shows a securing device according to the present invention.

The scenery arrangement is also provided with a number of securing devices 18, see FIG. 4, arranged to be secured by snapping them around a curtain rod 7 or back-drop rod 8. The securing device 18 is provided with an upwardly extending support means 19 in the form of a curved or bent tongue used as a holder for a pelmet. If the securing device is placed on the back-drop rod 8 the primary object of the support member is not to cover otherwise visible parts, but rather to provide hooks for various props or for hanging a permanent back-drop, such as a woodland background while the other back-drops can be exchanged to illustrate a glade, thick forest and a cottage in the forest. Another embodiment is to provide the embodiment shown FIG. in 1 with additionally at least on parallel back-drop rod in towards the front end of the scenery arrangement in order to carry additional back-drop covers. The securing device 18 is also provided with a downwardly extending hook means 20 with a hook 21. When the securing device 18 is used around the curtain rod 7 the hook 21 is used to hold up the curtain running along the cord 11. If the curtain is divided one securing device 18 is situated in the middle of the rod 7, one securing device 18 towards each end of the rod, close to each corner member, and one at each end of the curtain rod. Five securing devices are thus situated on the curtain rod. If the securing devices are placed on the back-drop rod 8, they may be turned so that the hook member 20 faces rearwards, enabling props to be hung up.

The tubular construction also comprises other rod sections 22, see FIG. 1, constituting support pieces for the construction and located at each of the four lower corner members 4 resting against the support surface, and possibly an additional rod section at each front lower corner member. These rod sections have a length of approximately 20 cm and can be connected to the corner members in the same way as the first rod sections 2.

A divided curtain has been indicated in broken lines in FIG. 1, to illustrate the function of the invention. A single curtain may also be used and is then operated all the way from the left side to the right side. Three back-drops with decor have also been indicate in broken lines in the Figure in order to show their function.

The components forming the construction can be varied infinitely within the scope of the invention.

I claim:

1. A mobile scenery arrangement, comprising:

a substantially vertical left side having front and rear corner members;

a substantially vertical right side having front and rear corner members;

an upper front curtain rod joining the left and right sides by means of the respective front corner members; and an upper rear back-drop rod joining the left and right sides by means of the respective rear corner members;

wherein each rod has two ends and supports a cord therebetween, at least one of the ends of each of said rods being provided with a cord-tensioning device arranged to steplessly stretch the respective cord between the two ends of the rod.

2. A mobile scenery arrangement as claimed in claim 1, wherein both ends of both the curtain rod and the back-drop rod are each provided with a respective cord-tensioning device arranged to stretch the respective cord between the two ends of each respective rod.

3. A mobile scenery arrangement as claimed in claim 1, wherein the cord-tensioning device is arranged to be threaded into a rod end and is provided with a retaining slot.

4. A mobile scenery arrangement as claimed in claim 3, wherein the cord-tensioning device is provided with at least one curtain hook.

5. A mobile scenery arrangement as claimed in claim 1, wherein both ends of both the curtain rod and the back-drop rod extend beyond the left and right sides, respectively.

6. A mobile scenery arrangement as claimed in claim 5, wherein the left and right sides are joined to at least one rear lower spacer.

7. A mobile scenery arrangement as claimed in claim 1, wherein the front and rear lower corners of the left and right sides are provided with at least one support piece.

8. A mobile scenery arrangement as claimed in claim 7, wherein the front lower corners of the left and right sides are provided with two support pieces.

9. A mobile scenery arrangement as claimed in claim 1, wherein a securing device is arranged to be secured around the curtain rod or the back-drop rod.

10. A mobile scenery arrangement as claimed in claim 9, wherein the securing device is provided with an upwardly extending support means.

11. A mobile scenery arrangement as claimed in claim 10, wherein the securing device is provided with a downwardly extending hook means having a hook to carry a cord.

12. A mobile scenery arrangement as claimed in claim 1, wherein said cord is arranged to displacably carry curtains or a back-drop.

13. A mobile scenery arrangement, comprising:

a substantially vertical left side having front and rear corner members;

a substantially vertical right side having front and rear corner members;

an upper front curtain rod joining the left and right sides by means of the respective front corner members; and an upper rear back-drop rod joining the left and right sides by means of the respective rear corner members;

wherein each rod has two ends and supports a cord therebetween, at least one of the ends of each of said rods being provided with a cord-tensioning device arranged to steplessly stretch the respective cord between the two ends of the rod;

wherein both ends of both the curtain rod and the back-drop rod are each provided with a respective cord-tensioning device arranged to stretch the respective cord between the two ends of each respective rod; and wherein both ends of both the curtain rod and the back-drop rod extend beyond the left and right sides, respectively.

14. A mobile scenery arrangement as claimed in claim 13, wherein the cord-tensioning device is arranged to be threaded into a rod end and is provided with a retaining slot.

15. A mobile scenery arrangement as claimed in claim 13, wherein the cord-tensioning device is provided with at least one curtain hook.

16. A mobile scenery arrangement as claimed in claim 13, wherein the left and right sides are joined to at least one rear lower spacer.

17. A mobile scenery arrangement as claimed in claim 13, wherein the front and rear lower corners of the left and right sides are provided with two support pieces.

18. A mobile scenery arrangement as claimed in claim 13, wherein a securing device is arranged to be secured around the curtain rod or the back-drop rod, wherein the securing device is provided with an upwardly extending support means, and wherein the securing device is provided with a downwardly extending hook means having a hook to carry a cord.

19. A mobile scenery arrangement, comprising:

a substantially vertical left side having front and rear corner members;

a substantially vertical right side having front and rear corner members;

an upper front curtain rod joining the left and right sides by means of the respective front corner members;

an upper rear back-drop rod joining the left and right sides by means of the respective rear corner members; and a securing device arranged to be secured around the curtain rod or the back-drop rod;

wherein each rod has two ends and supports a cord therebetween, at least one of the ends of each of said rods being provided with a cord-tensioning device arranged to steplessly stretch the respective cord between the two ends of the rod;

wherein the securing device is provided with an upwardly extending support means, and wherein the securing device is provided with a downwardly extending hook means having a hook to carry a cord; and wherein the mobile scenery arrangement has a tubular construction, said cord is arranged to displacably carry curtains or a back-drop, and wherein the tubular construction includes eight identical corner members, each with four pipe connections.

20. A mobile scenery arrangement as claimed in claim 19, wherein the tubular construction comprises first rod sections constituting the left and right sides, the upper front curtain rod, the upper rear back-drop rod and a spacer, all first rod sections having a uniform first length of preferably 1 m, and second rod sections constituting support pieces having a uniform second length of preferably 20 cm, all rod sections being connectable to each other and to the corner members.

* * * * *